United States Patent [19]

Baatz et al.

[11] 4,235,739

[45] Nov. 25, 1980

[54] CANISTER METHOD OF DISPOSING OF RADIOACTIVE WASTE

[75] Inventors: Henning Baatz, Essen; Dieter Rittscher, Heiligenhaus, both of Fed. Rep. of Germany

[73] Assignee: Steag Kernenergie GmbH, Essen, Fed. Rep. of Germany

[21] Appl. No.: 903,093

[22] Filed: May 5, 1978

[30] Foreign Application Priority Data

May 6, 1977 [DE] Fed. Rep. of Germany ..... 2720342

[51] Int. Cl.[2] ..... G21F 9/16

[52] U.S. Cl. ..... 252/301.1 W; 366/16; 366/34; 366/40; 366/57; 366/139

[58] Field of Search ..... 252/301.1 W; 366/16, 366/34, 40, 139, 185, 57

[56] References Cited

U.S. PATENT DOCUMENTS

| | | | |
|---|---|---|---|
| 3,912,239 | 10/1975 | Ries | 366/40 |
| 3,940,628 | 2/1976 | Stock et al. | 252/301.1 W |
| 4,042,222 | 8/1977 | Clement | 366/57 |

FOREIGN PATENT DOCUMENTS

| | | | |
|---|---|---|---|
| 2304995 | 10/1976 | France | 252/301.1 W |

OTHER PUBLICATIONS

Queiser, H., "Treatment of Radioactive Slurry . . . ", *Nucl. Eng. Intl.*, vol. 20, No. 225 (Feb. 1975), pp. 108–110.

*Primary Examiner*—Brooks H. Hunt
*Assistant Examiner*—Deborah L. Kyle
*Attorney, Agent, or Firm*—Karl F. Ross

[57] ABSTRACT

A substantially cylindrical canister is oriented in an upright position with its fill hole directed upwardly, and hydraulic cement is loaded into the top of this canister. The canister is then tipped on its side and connected via a swivel coupling to a suction line and to a line through which a radioactive-waste slurry may be fed. The interior of the canister is then evacuated and the canister is rotated about a horizontal axis passing through this swivel coupling. Radioactive waste is then sucked into the canister by the subatomospheric pressure therein and is intimately mixed with cement already inside the canister by inwardly projecting mixing vanes provided inside the canister.

1 Claim, 2 Drawing Figures

CANISTER METHOD OF DISPOSING OF RADIOACTIVE WASTE

FIELD OF THE INVENTION

The present invention relates to a method of disposing of radioactive waste. More particularly, this invention comprises a method for packaging such waste in safe containers.

BACKGROUND OF THE INVENTION

Radioactive waste is typically disposed of by packaging it in heavy-duty canisters. In order to maximize the security of such containers, they are made of shielding, often lead-filled material. Furthermore the radioactive waste itself is normally mixed with a binder, normally a bitumen, so that even if a canister is broken open the radioactive waste contained thereby will not be able to escape or run off. Such an arrangement is described in German patent publication 2,511,957.

Normally the radioactive material is poured into the containers or introduced in fluid form. Thereafter the binder is injected into the partially filled canister and a simple mixer head is inserted into the canister and rotated to mix the binder and waste together.

OBJECTS OF THE INVENTION

It is an object of the invention to provide an improved method of disposing of and packaging radioactive waste.

Another object is to provide such an improved method which allows a dry, granulate or powder-form material, such as cement, to be used as the binder.

A further object is the provision of such method and system which insures in a very simple manner an extremely intimate mixing of the binder with the radioactive waste.

SUMMARY OF THE INVENTION

These objects are attained according to the invention in an arrangement where the canister, which is normally shaped as a body of a revolution, e.g. a cylinder, is held in a holder that can be tipped about a horizontal axis for orientation of the canister with its central axis horizontal and its fill hole opening horizontally. Furthermore means is provided for rotating the canister about its central horizontal axis when thus tipped so that the waste and binder can be intimately mixed.

According to further features of this invention the waste is introduced through the fill hole into the container via a swivel coupling during rotation of the container about its horizontally oriented canister axis. What is more a suction line can be connected to the interior of the canister at this fill hole via the coupling for placing the interior of the canister under a predetermined subatmospheric pressure so that the fluent radioactive waste can be sucked by the pressure differential into the canister for filling thereof.

Thus with the system according to the present invention it is possible to first charge the binder into the canister while same is in the upright position. This can most simply be done by loading into the canister premeasured bags of cement, the bags being formed of polyvinyl alcohol, so that once the radioactive waste, which contains water or has water as a vehicle, enters the canister the bag will dissolve. Thereafter the canister is tipped on its side and connected to the swivel coupling through which the fluent radioactive waste is fed into the canister. In addition a vacuum line can be connected through this swivel coupling to the interior of the canister so that the interior of the canister can be placed under subatmospheric pressure. When the valve is open in the line to the fluent radioactive waste this subatmospheric pressure will suck a predetermined quantity of the waste into the canister. Simultaneous rotation of the canister during all of these operations will insure extremely intimate mixing of the binder with the radioactive waste. The amount of cement can easily be calculated in accordance with the known quantity of water to be admitted with the radioactive waste.

It is possible to operate in accordance with the system such as described in German patent application 2,544,447.7 wherein the radioactive waste from a reactor tank can be fed into the canister through a pressurizing pump and wherein a vacuum pump can be connected to the canister. Furthermore the canister can be connected via a low-pressure or vacuum line back to the reactor tank. The system is set up so that the particulate radioactive material is carried as a suspension into the canister and allowed to sediment therein, the excess water being fed back into the reactor tank. In such an arrangement the granular cement is only added at the last stages.

In accordance with yet another feature of this invention mixing formations are provided inside the canister, normally in the form of inwardly directed vanes. As the canister is rotated these mixing formations insure excellent homogenization of the binder-waste mixture.

With the system according to the instant invention radioactive waste can be packaged in an extremely neat and simple manner. Evacuation of the interior of the canister before and during loading produces an almost perfectly porefree concrete formed of a mixture of cement and the radioactive waste, the latter normally being simple salt solutions. As a result of the intimate mixing a solid block is formed inside the canister so that even if the canister breaks open, the waste contained therein will not be messy and difficult to handle.

SPECIFIC DESCRIPTION

Figure 1:
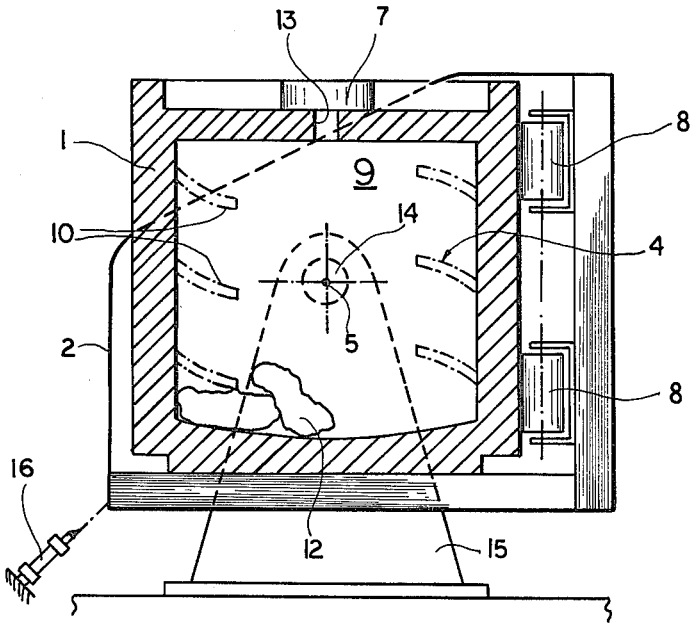
FIG. 1 is a side view in partly diagrammatically form of the system according to this invention.
Figure 2:
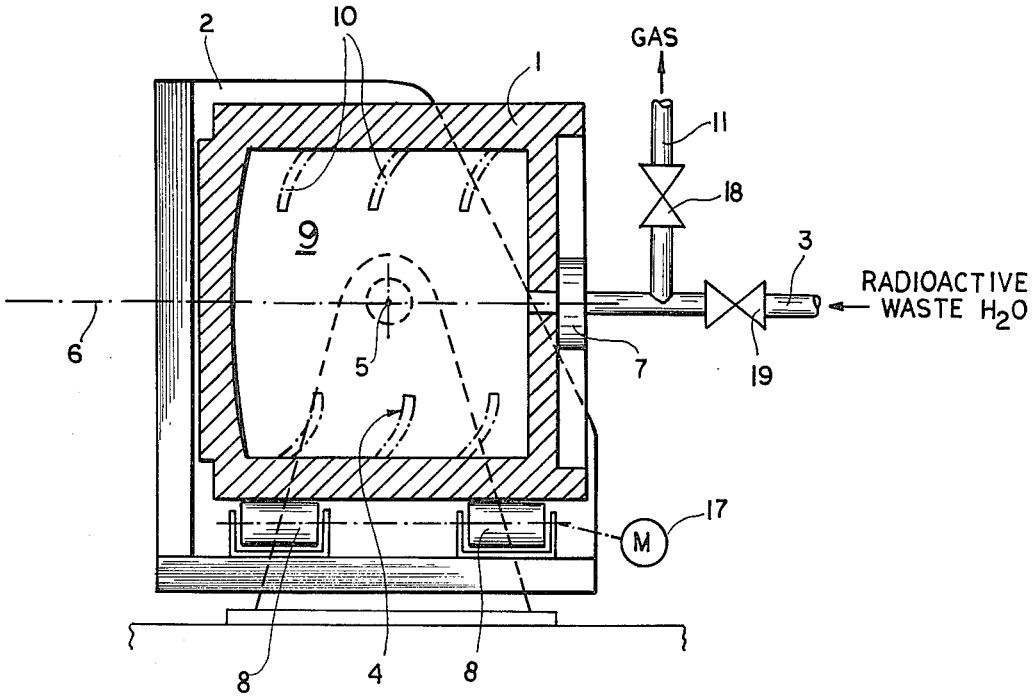
FIG. 2 is a view similar to FIG. 1 but showing the arrangement in another operating position.

As shown in FIGS. 1 and 2 radioactive waste according to this invention is disposed of by packaging it in a cylindrical lead-containing canisters 1 having a hollow interior 9. At the start of the operation each container 1 is set on a cradle or holder 2 so that the central axis 6 of the container is upright and the fillhole 13 is directed upwardly. The holder 2 has gudgeons 14 received in a pair of trunnions 15 defining a horizontal tipping axis 5 perpendicular to and intersecting the axis 6 of the holder 2. A hydraulic cylinder 16 or the like is connected to the holder 2 to tip it through 90° between the upright position shown in FIG. 1 to the tipped position shown in FIG. 2 in which the axis 6 is horizontal and the fill opening 13 opens horizontally also. In this tipped position of FIG. 2 the cylindrical canister 1 rests on rollers 8 in the holder 1. A motor 17 connected to one of these rollers 8 can then be actuated to rotate the canister 16 about the horizontal axis 6.

Prior to tipping bags 12 of hydraulic cement are dropped into the canister 1 through the opening 13. These bags 12 are made of polyvinyl alcohol so that they dissolve in water.

A swivel coupling 7 can have one side connected to the canister 1 over the opening 13 in gastight and fluid-tight fashion and the other side connected to a conduit 3 through which radioactive-waste granules and water in a slurry may be fed and to a conduit 11 through which gas may be aspirated.

After tipping of the canister gases are aspirated from inside through the conduit 11. Once a predetermined quantity of gas, here air, has been thus aspirated the valve 18 in the conduit 11 is closed and the valve 19 in the conduit 3 is open. This allows the subatmospheric pressure inside the interior 9 to suck a quantity of the radioactive slurry into the canister 1. As soon as the water of the slurry comes into contact with the bags 12 of cement these bags dissolve. The amount of radioactive waste sucked in will be directly proportional to the amount of air sucked out so that it is possible very exactly to meter the flow.

The interior 9 of the canister 1 is provided with a mixer arrangement 4 in the form of radially inwardly projecting vanes 10. As the cement from the bags 12 tumbles with the radioactive waste, an extremely intimate mixture is formed by means of these vanes 10.

After sufficient mixing the canister 1 can be stood up again in the position of FIG. 1 and the concrete therein formed by the mixture of the radioactive-waste slurry and the cement will cure into concrete. As a result of the very low pressure inside the canister 1 an almost completely nonporous concrete is formed which is extremely strong and dense.

We claim:

1. A method of packaging radioactive waste, said method comprising the steps of:

supporting a canister having a substantially central fill hole lying on a canister axis with said hole directed upwardly and said axis upright;

introducing dry cement granules into said canister;

thereafter tipping said canister about a horizontal axis into a tipped position with said canister axis horizontal and said fill hole directed horizontally;

aspirating gas from the interior of said canister through said fill hole to create a subatmospheric pressure in said interior;

rotating said canister about said canister axis while maintaining said canister in said tipped position; and thereafter sucking fluent radioactive waste into said canister through said fill hole with said subatmospheric pressure while rotating said canister about said canister axis in said tipped position and thereby mixing said waste with said cement.

* * * * *